US008073372B2

(12) United States Patent
McNamee et al.

(10) Patent No.: US 8,073,372 B2
(45) Date of Patent: Dec. 6, 2011

(54) APPARATUSES INCLUDING A VIBRATING STRIPPING DEVICE FOR STRIPPING PRINT MEDIA FROM A BELT AND METHODS OF STRIPPING PRINT MEDIA FROM BELTS

(75) Inventors: Brian J. McNamee, Brockport, NY (US); David B. Montfort, Webster, NY (US); Brendan H. Williamson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/697,657

(22) Filed: Feb. 1, 2010

(65) Prior Publication Data

US 2011/0188903 A1 Aug. 4, 2011

(51) Int. Cl.
*G03G 15/20* (2006.01)

(52) U.S. Cl. ..... 399/323

(58) Field of Classification Search ..... 399/319, 399/323, 329; 271/307
See application file for complete search history.

(56) References Cited

U.S. PATENT DOCUMENTS 5,010,369 A 4/1991 Nowak et al.
6,157,804 A 12/2000 Richmond et al.
7,319,838 B2 * 1/2008 Baba et al. ..... 399/323
7,398,045 B2 * 7/2008 Uehara et al. ..... 399/329
7,529,512 B2 5/2009 Adams et al.
7,848,669 B2 * 12/2010 Torimaru ..... 399/319
2008/0037069 A1 2/2008 Mestha et al.

OTHER PUBLICATIONS

Wikipedia; Piezoelectricity; http://en.wikipedia.org/w/index.php?title=Piezoelectricity&printable=yes; p. 1-13; Jan. 20, 2010.

* cited by examiner

*Primary Examiner* — William J Royer
(74) *Attorney, Agent, or Firm* — Ronald E. Prass, Jr.; Prass LLP

(57) ABSTRACT

Apparatuses useful in printing onto media and methods for stripping print media from belts are disclosed. An exemplary apparatus useful in printing onto media includes a first member including a first surface; a second member; a fixing belt supported on the second member, the fixing belt including an inner surface and an outer surface, the first surface and the second surface forming a nip at which media are received; and a vibrating stripping device disposed between the second member and the inner surface of the fixing belt. The vibrating stripping device includes a stripping member including a stripping surface and a drive mechanism. The drive mechanism produces vibration of the stripping surface and the fixing belt, and the vibration of the fixing belt assists separation of media passed through the nip from the outer surface of the fixing belt adjacent to the stripping surface of the stripping member.

21 Claims, 5 Drawing Sheets

APPARATUSES INCLUDING A VIBRATING STRIPPING DEVICE FOR STRIPPING PRINT MEDIA FROM A BELT AND METHODS OF STRIPPING PRINT MEDIA FROM BELTS

BACKGROUND

Some printing apparatuses include a belt and a roll that form a nip. In such apparatuses, media are fed to the nip and contacted with the belt to fix marking material onto the media. The media are separated from the belt after they pass through the nip.

It would be desirable to provide apparatuses useful in printing onto media and associated methods that can be used to separate different types of media from belts more effectively.

SUMMARY

Apparatuses useful in printing onto media and methods of stripping print media from belts are disclosed. An exemplary embodiment of the apparatuses useful in printing onto media comprises a first member including a first surface; a second member; a fixing belt supported on the second member, the fixing belt including an inner surface and an outer surface, the first surface and the outer surface forming a nip at which media are received; and a vibrating stripping device disposed between the second member and the inner surface of the fixing belt. The vibrating stripping device comprises a stripping member including a stripping surface and a drive mechanism. The drive mechanism produces vibration of the stripping surface and the fixing belt, and the vibration of the fixing belt assists separation of media passed through the nip from the outer surface of the fixing belt adjacent to the stripping surface of the stripping member.

DRAWINGS

DETAILED DESCRIPTION

Figure 1:
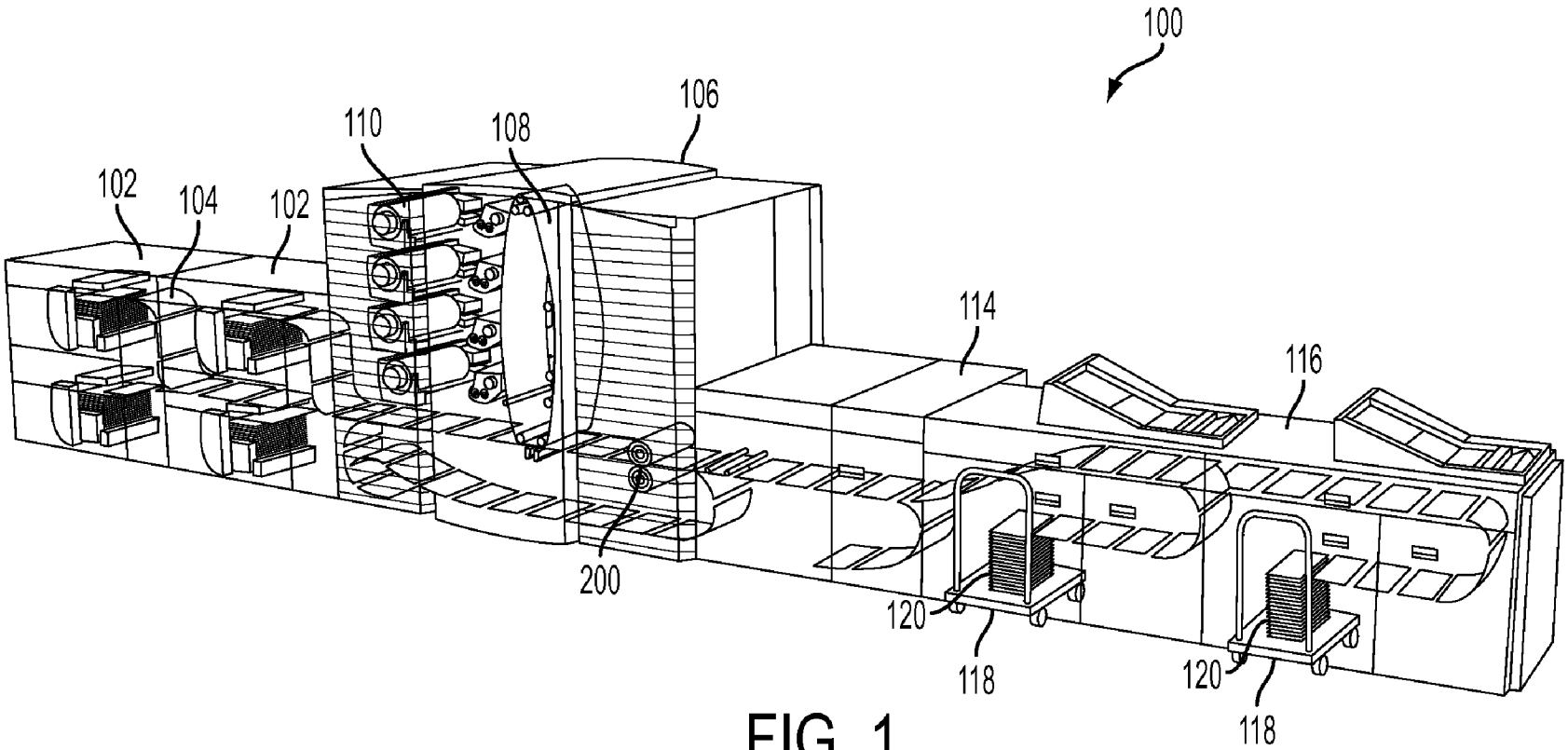
FIG. 1 depicts an exemplary embodiment of a printing apparatus.

The disclosed embodiments include apparatuses useful in printing onto media. An exemplary embodiment of the apparatuses comprises a first member including a first surface; a second member; a fixing belt supported on the second member, the fixing belt including an inner surface and an outer surface, the first surface and the outer surface forming a nip at which media are received; and a vibrating stripping device disposed between the second member and the inner surface of the fixing belt. The vibrating stripping device comprises a stripping member including a stripping surface and a drive mechanism. The drive mechanism produces vibration of the stripping surface and the fixing belt, and the vibration of the fixing belt assists separation of media passed through the nip from the outer surface of the fixing belt adjacent to the stripping surface of the stripping member.

Another exemplary embodiment of the apparatuses useful in printing onto media comprises a first roll including a first surface; a second roll including a second surface; a heated fixing belt including an inner surface and an outer surface; a first nip formed by contact between the inner surface of the fixing belt and the second surface and contact between the outer surface of the fixing belt and the first surface, the first nip including a first inlet end and a first outlet end at which the fixing belt separates from the second surface; a second nip formed by contact between the outer surface of the fixing belt and the first surface, the second nip extending from the first outlet end to a second outlet end at which the fixing belt separates from the first surface; and a vibrating stripping device disposed between the second surface and the inner surface of the fixing belt. The vibrating stripping device comprises a stripping member including a stripping surface and a drive mechanism. The drive mechanism produces vibration of the stripping surface and the fixing belt, and the vibration of the fixing belt assists separation of media passed through the first nip and the second nip from the outer surface of the fixing belt adjacent to the stripping surface of the stripping member.

The disclosed embodiments further include methods of stripping media from surfaces in apparatuses useful in printing onto media. In an exemplary embodiment of the methods, the apparatus comprises a first member including a first surface, a second member including a second surface, a fixing belt supported on the second surface, the fixing belt including an inner surface and an outer surface, the first surface and the outer surface forming a nip at which media are received, and a vibrating stripping device disposed between the second surface and the inner surface of the fixing belt, the vibrating stripping device comprising a stripping member including a stripping surface and a drive mechanism. The method comprises activating the drive mechanism to produce vibration of the stripping surface and the fixing belt; feeding a medium carrying a marking material to the nip, the marking material contacting the outer surface of the fixing belt; and stripping the medium from the outer surface of the fixing belt after the medium passes through the nip, wherein the vibration of the fixing belt assists separation of the medium from the outer surface of the fixing belt adjacent to the stripping surface of the stripping member.

As used herein, the term "printing apparatus" encompasses any apparatus that performs a print outputting function for any purpose. Such apparatuses can include, e.g., printers, copiers, facsimile machines, bookmaking machines, multifunction machines, and the like.

In fixing devices that include a fixing belt, the ability to strip more-difficult media, such as lightweight media, from the outer surface of the fixing belt after marking material has been fixed onto the media by the application of heat can be enhanced by placing a stationary stripping device in contact with the inner surface of the fixing belt. The stripping device produces a stripping force that enhances stripping of such media from the belt outer surface.

It has been noted, however, that the stripping force produced by such stripping devices may not be sufficient for stripping all media types from fixing belts satisfactorily. For example, when the lower limit of media basis weight is above a desired state, it may be desirable to employ additional methods of stripping enhancement, such as an air knife. However, it has been noted that the use of air knives can introduce new problems in the apparatuses. For example, the use of air knives can result in differential cooling of images and corresponding differential gloss. In addition, the use of compressed air in such air knives can move heat from the fixing belt to undesirable locations in printing apparatuses, such as to transports and baffles, which can cause other types of image quality defects. Accordingly, it would be desirable to provide fixing devices including fixing belts that can effectively strip different media types, including lightweight media, from the fixing belts without using an air knife.

In light of these and other considerations, apparatuses useful in printing onto media and methods of stripping media from surfaces are provided. Embodiments of the apparatuses include a heated fixing belt. In embodiments, the fixing belt and an opposing member forms a nip. Media to which marking material has been transferred upstream of the fixing device are received at the nip. At the nip, heat and pressure can be applied by the fixing belt and other member to fix the marking material onto the media. After passing through the nip, the media are stripped (mechanically separated) from the outer surface of the fixing belt using a vibrating stripping device that can introduce relatively high-frequency vibrations to the fixing belt. This vibration enhances the separation of the media/marking material from the fixing belt, thereby improving stripping performance. Embodiments of the fixing devices do not include an air knife for stripping media.

FIG. 1 illustrates an exemplary printing apparatus 100, as disclosed in U.S. Patent Application Publication No. 2008/0037069, which is incorporated herein by reference in its entirety. The printing apparatus 100 can be used to produce prints from different types of media having different sizes and weights. The printing apparatus 100 includes two media feeder modules 102 arranged in series, a printer module 106 adjacent the media feeder modules 102, an inverter module 114 adjacent the printer module 106, and two stacker modules 116 arranged in series adjacent the inverter module 114.

In the printer module 106, marking material (toner) is transferred from developer stations 110 to a charged photoreceptor belt 108 to form images on the photoreceptor belt 108 and produce prints. The images are transferred to one side of media 104 fed through a paper path. The media 104 are advanced through a fixing device 200. The inverter module 114 manipulates media 104 exiting the printer module 106 by either passing the media 104 through to the stacker modules 116, or inverting and returning the media 104 to the printer module 106. In the stacker modules 116, the printed media 104 are loaded onto stacker carts 118 to form stacks 120.

Figure 2:
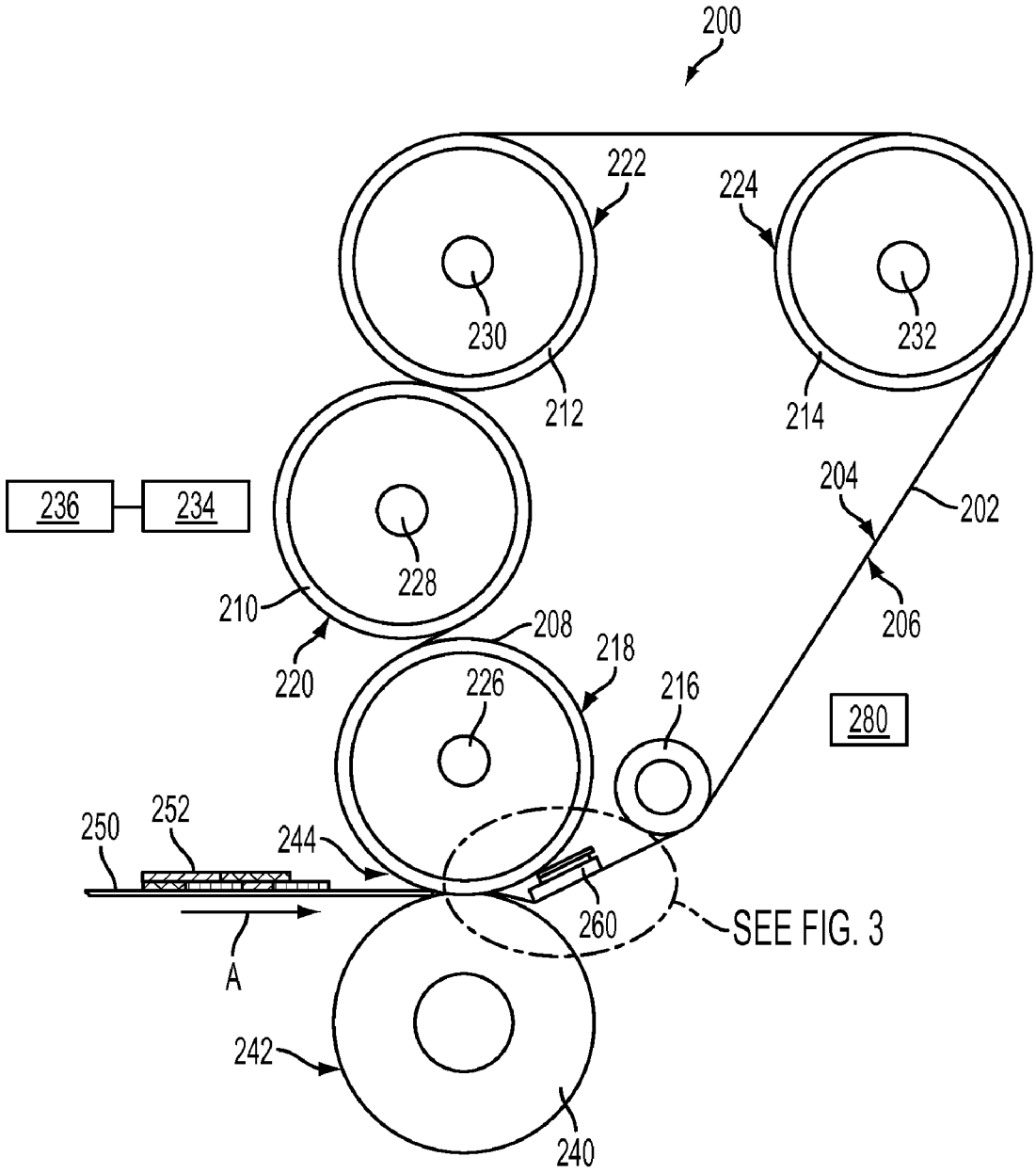
FIG. 2 depicts an exemplary embodiment of a fixing device including a fixing belt and a vibrating stripping device.

FIG. 2 illustrates an exemplary embodiment of a fixing device 200. The fixing device 200 includes an endless (continuous) fixing belt 202 supported on a fixing roll 208, an external roll 210 and internal rolls 212, 214 and 216. Other embodiments of the fixing device 200 can have different architectures, such as a different number of rolls supporting the fixing belt 202, and external rolls, such as heater rolls.

The fixing belt 202 includes an inner surface 204 and an outer surface 206. The fixing roll 208, external roll 210 and internal rolls 212, 214 include outer surfaces 218, 220 222 and 224, respectively, contacting the fixing belt 202. In the illustrated embodiment, the fixing belt 202 is actively heated. As shown, the fixing roll 208, external roll 210 and internal rolls 212, 214 are internally heated by heating elements 226, 228, 230 and 232, respectively. The heating elements 226, 228, 230 and 232 can include one or more axially-extending lamps. The heating elements 226, 228, 230 and 232 are supplied power by a power supply 234 connected to a controller 236 to control heating of the fixing belt 202.

The fixing device 200 further includes an external pressure roll 240 including an outer surface 242. A nip 244 is formed by the fixing belt 202 and the pressure roll 240. In embodiments, the outer surface 242 of the pressure roll 240 can be comprised of an elastically deformable material, such as silicone rubber, perfluoroalkoxy (PFA) copolymer resin, or the like.

Embodiments of the fixing belt 202 can have a multi-layer construction including, e.g., a base layer, an intermediate layer on the base layer, and an outer layer on the intermediate layer. In such embodiments, the base layer forms the inner surface 204, and the outer layer forms the outer surface 206 of the fixing belt 202. In an exemplary embodiment of the fixing belt 202, the base layer can be composed of a polymeric material, such as polyimide, or the like; the intermediate layer can be composed of silicone, or the like; and the outer layer can be composed of a polymeric material, such as a fluoroelastomer sold under the trademark Viton® by DuPont Performance Elastomers, L.L.C., polytetrafluoroethylene (Teflon®), or the like.

In embodiments, the fixing belt 202 may have a thickness of less than about 2 mm, and be referred to as a "thin belt." The fixing belt 202 can typically have a width of at least about 200 mm, and a length of at least about 200 mm.

FIG. 2 depicts a medium 250 traveling in the process direction, A, being received at the nip 244. The medium 250 includes marking material 252 (e.g., toner) on a surface. The marking material 252 contacts the outer surface 206 of the fixing belt 202 at the nip 244. The fixing roll 208 is rotated counter-clockwise, and the pressure roll 240 is rotated clockwise, to convey the medium 250 through the nip 244 in the process direction A and rotate the fixing belt 202 counter-clockwise.

The medium 250 can be a sheet of paper, a transparency or packaging material, for example. Paper is typically classified by weight, as follows: lightweight: ≦about 75 gsm, midweight: about 75 gsm to about 160 gsm, and heavyweight: ≧160 gsm.

As shown in FIG. 2, the fixing device 200 further includes a vibrating stripping device 260 for enhancing stripping of media from the outer surface 206 of the fixing belt 202 after the media pass through the nip 244 traveling in the process direction A.

Figure 3:
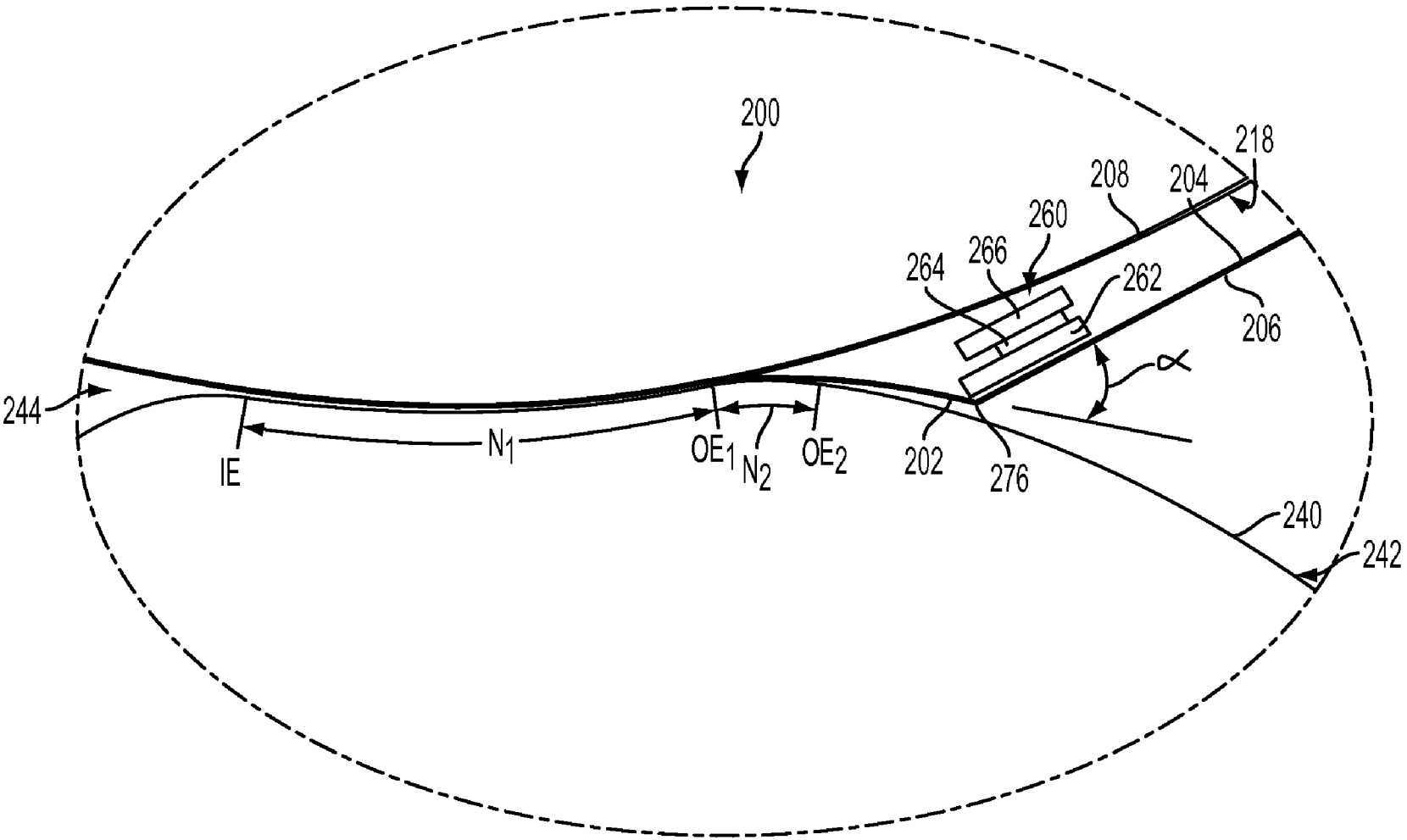
FIG. 3 depicts an enlarged partial view of a portion of the fixing device of FIG. 2.

FIG. 3 is an enlarged view depicting a portion of the fixing device 200 shown in FIG. 2. As shown, the vibrating stripping device 260 is located between the fixing belt 202 and the fixing roll 208. The nip 244 includes both a first nip, $N_1$, and a second nip, $N_2$. The first nip $N_1$ extends in the process direction A between an inlet end, IE, where media enter the first nip $N_1$, and an outlet end $OE_1$, where the media exit from the first nip $N_1$. At the first nip $N_1$, the fixing belt 202 contacts the outer surface 218 of the fixing roll 208 and the outer surface 242 of the pressure roll 240. The fixing belt 202 and pressure roll 240 apply sufficient thermal energy and pressure to media fed to the first nip $N_1$ to fix marking material onto the media.

As shown in FIG. 3, the fixing belt 202 separates from the outer surface 218 of the fixing roll 208 at the outlet end $OE_1$ of the first nip $N_1$. The outer surface 206 of the fixing belt 202 and the outer surface 242 of the pressure roll 240 forms the second nip $N_2$ adjacent to the outlet end $OE_1$ of the first nip $N_1$. The second nip $N_2$ extends from the outlet end $OE_1$ to an outlet end $OE_2$. The second nip $N_2$ facilitates stripping of media from the outer surface 206 of the fixing belt 202. At the second nip $N_2$, the outer surface 206 of the fixing belt 202 applies low pressure to the outer surface 242 of the pressure roll 240.

In embodiments, the vibrating stripping device 260 can be positioned in contact with the inner surface 204 of the fixing belt 202 downstream from the outlet end $OE_2$ of the second nip $N_2$. As shown, the vibrating stripping device 260 includes an edge having a stripping surface 276. At the stripping surface 276, the fixing belt 202 bends at a stripping angle, $\alpha$.

The vibrating stripping device 260 includes a stripping member 262 and a drive mechanism for vibrating the stripping member 262 at a desired frequency. In the illustrated embodiment, the drive mechanism includes one or more piezoelectric elements 264 (a single piezoelectric element 264 is shown in FIG. 2). The stripping member 262 and piezoelectric elements 264 form an acoustic transducer. The piezoelectric elements 264 are located between the stripping member 262 and a support member 266. In embodiments, the piezoelectric elements 264 are arranged in series along the length dimension of the vibrating stripping device 260.

The support member 266 can be rigidly attached to a portion of the printing apparatus 100, such as a sub-frame, in which the vibrating stripping device 260 is provided. In the printing apparatus 100 shown in FIG. 1, the support member 266 can be fixedly (non-movably) attached to a sub-frame portion of the printer module 106.

The stripping member 262 can be constructed from any suitable material, such as a metal or polymer. The surface of the stripping member 262 that faces the inner surface 204 of the fixing belt 202 can be comprised of a material that reduces friction between the stripping member 262 and the inner surface 204. The stripping member 262 can have a generally rectangular configuration, as shown, and be referred to as a stripping shoe. The stripping surface 276 is shown contacting the inner surface 204 of the fixing belt 202. The stripping surface 276 can have a curved shape (convex outward) to reduce frictional wear of the inner surface 204. The stripping surface 276 can be defined by a radius of about 0.5 mm to about 5 mm, for example. A larger radius of the stripping surface 276 can reduce mechanical stress on the fixing belt 202. The stripping member 262 has a sufficient length approximately along the axial direction of the fixing roll 208 to contact the entire width of the fixing belt 202. In the fixing device 200, the fixing belt 202 can be coupled against the stripping member 262 through a tensioning mechanism.

In embodiments, the piezoelectric elements 264 are attached to the stripping member 262 and the support member 266, such as by adhesive bonding, or the like. As shown, the piezoelectric elements 264 can have a plate configuration. The size of the piezoelectric elements 264 can be selected based on factors including their composition, and inertia and loading of the vibrating stripping device 260 to provide optimal transfer of stripping energy through the fixing belt 202 at a resonant frequency of the vibrating stripping device 260.

The piezoelectric elements 264 can comprise any suitable material that exhibits the reverse piezoelectric effect; i.e., the production of strain in the material when an electrical current is applied to the material, and can provide the desired stripping force to the fixing belt 202. The strain in the piezoelectric elements 264 caused by the applied electrical current results in a shape and/or volume change. The magnitude and frequency of the shape and/or volume change in the piezoelectric elements 264 is sufficient to induce the desired movement to the stripping member 262 relative to the fixing belt 202 to reduce adhesion of media/marking material contacting the outer surface 206 sufficiently to separate the media/marking material from the fixing belt 202.

Figure 4:
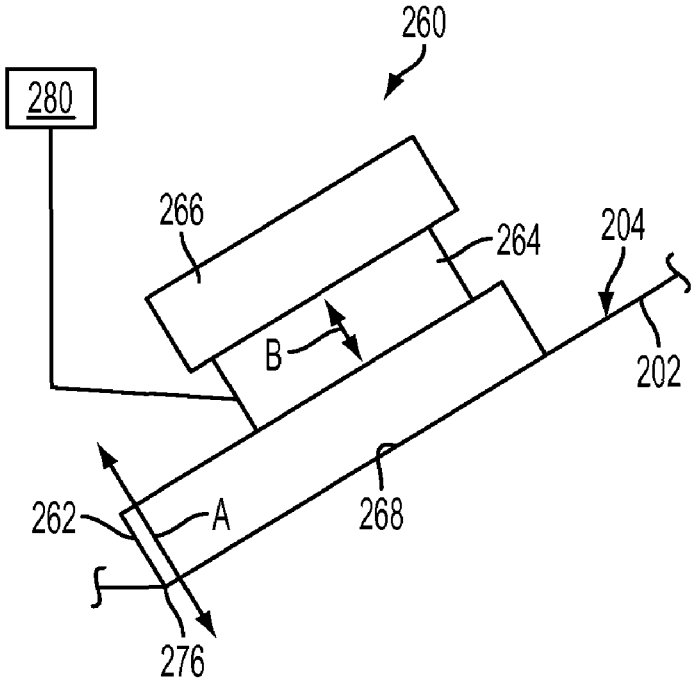
FIG. 4 depicts a portion of an exemplary embodiment of a vibrating stripping device in a fixing device.

In embodiments, the drive mechanism supplies electrical current to the piezoelectric elements 264. As shown in FIG. 4, when electrical current is supplied to the piezoelectric elements 264, the piezoelectric elements 264 can change volume in reverse directions B toward and away from the fixing belt 202. The directions B can be perpendicular to the inner surface 204 of the fixing belt 202. When the piezoelectric elements 264 expand, the stripping member 262 moves in the direction A toward the fixing belt 202, while when the piezoelectric elements 264 contract, the stripping member 262 moves in direction A away from the fixing belt 202. The directions A can be perpendicular to the inner surface 204 of the fixing belt 202. This reverse motion induces vibration of the stripping surface 276 at which the fixing belt 202 contacts the stripping member 262 and adjacent to which media are separated from the outer surface 206 of the fixing belt 202.

The piezoelectric elements 264 can comprise, e.g., a crystal, such as quartz, gallium orthophosphate ($GaPO_4$), langasite ($La_3Ga_5SiO_{14}$), or the like; a ceramic, such as barium titanate ($BaTiO_3$), lead titanate ($PbTiO_3$), lead zirconate titanate ($Pb[Zr_xTi_{1-x}]O_3$, $0 \leqq x \leqq 1$) (PZT), potassium niobate ($KNbO_3$), lithium niobate ($LiNbO_3$), sodium tungstate ($Na_2WO_3$), sodium potassium niobate (NaKNb), bismuth ferrite ($BiFeO_3$), sodium niobate ($NaNbO_3$), or the like; or a polymer, such as polyvinylidene fluoride (PVDF), or the like.

In embodiments, certain elements of the vibrating stripping device 260, such as more temperature-sensitive piezoelectric elements, may be cooled in the fixing device 200.

The piezoelectric elements 264 of the vibrating stripping device 260 are driven electrically by a driver 280 of the drive mechanism. The driver 280 supplies an electrical current to the piezoelectric elements 264 effective to cause the piezoelectric elements 264 to change shape and/or volume to provide relatively high-frequency vibration to the fixing belt 202. This vibration enhances the separation of media/marking material from the outer surface 268 of the fixing belt 202 to thereby improve stripping performance. When the fixing belt 202 is coupled to the stripping member 262, the fixing belt 202 is able to follow the motion of the stripping surface 276 caused by high-frequency shape and/or volume changes of the piezoelectric elements 264 and experience high acceleration in directions substantially normal to the process direction of the fixing belt 202. The high-frequency vibratory motion focused at the stripping surface 276 provides sufficient inertial detachment energy to assist the stripping function coincident with the contour (e.g., curvature with a small bend radius) of the stripping surface 276. The combined inertial detachment energy and surface strain counteract the adhesion force of media/marking material to the outer surface 268 of the fixing belt 202, allowing robust stripping to occur at the stripping surface 276. The surface strain and inertial detachment force produced at the interface between the outer surface 268 of the fixing belt 202 and the media/marking material are sufficient to enhance mechanical stripping of various types of media, including more-difficult, light-weight media.

The acceleration of the stripping surface 276 can be controlled with the driver 280 to control the stripping force. For a given amplitude of the movement of the stripping surface 276, as the frequency is increased, the acceleration of the stripping surface 276 is increased, which increases the stripping force. A higher stripping force is desirable for stripping light-weight media, while a lower stripping force is typically sufficient for stripping heavy-weight media, which can be substantially "self-stripping."

The driver 280 can comprise, e.g., an electrical power driver circuit as disclosed in U.S. Pat. No. 6,157,804 to Richmond et al., which is incorporated herein by reference in its entirety. The vibrating stripping device 260 including the stripping member 262, piezoelectric elements 264 and support member 266 (when the support member 266 is rigidly attached to the piezoelectric elements 264) can be driven at a relatively high frequency by the driver 280. For example, the driver 280 can be operated at a frequency, f, of about 5 KHz to about 200 KHz, such as about 5 KHz to about 50 KHz, about 50 KHz to about 100 KHz, or about 100 KHz to about 200 KHz. The vibrating stripping device 260 has a natural resonant frequency, which is a function of the masses, loads and geometry of all components of the vibrating stripping device 260. When the fixing belt 202 is coupled to the vibrating stripping device 260, the system including the vibrating stripping device 260 and fixing belt 202 has a natural resonant frequency. The resonance of the vibrating stripping device 260, or the system, changes with variations in temperature and/or load. The vibrating stripping device 260, or the system, can be driven by the driver 280 to vibrate at its resonant frequency under different temperature and load conditions. Embodiments of driver 280 can include a phase lock loop power supply, as described in Richmond et al., to track, and adjust to, variations in the resonant frequency of the vibrating stripping device 260 or system.

The voltage supplied by the driver 280 to the piezoelectric elements 264 is synonymous to vibration energy. The voltage can be tuned based on the type of media used in the fixing device 200. For example, the voltage can be adjusted based on the substrate basis weight, with a higher or lower voltage being supplied for the stripping of different media weights. This voltage adjustment can be provided, e.g., via software control in any suitable controller connected to the driver 280.

Figure 5:
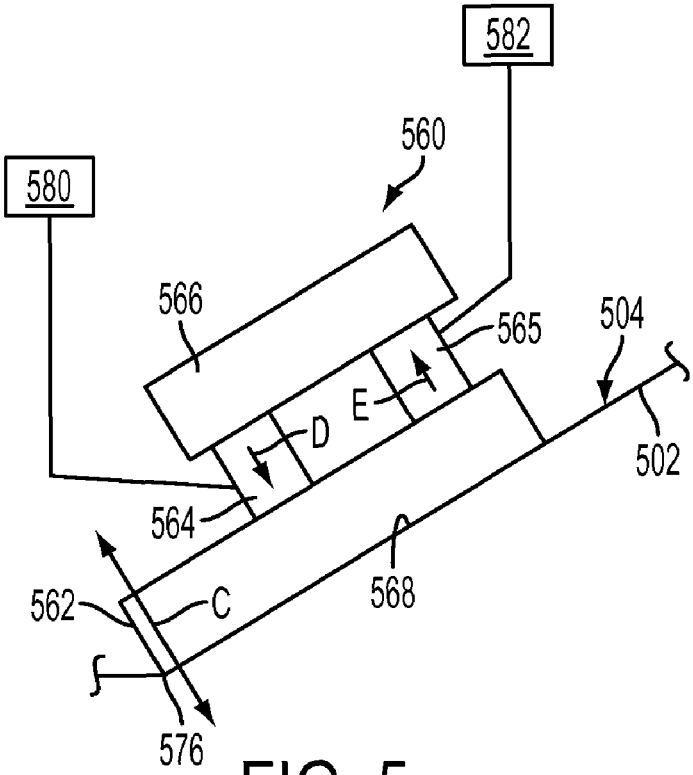
FIG. 5 depicts another exemplary embodiment of a vibrating stripping device in a fixing device.

FIG. 5 depicts a portion of a fixing device including a vibrating stripping device 560 according to another exemplary embodiment. The vibrating stripping device 560 can be used in the fixing device 200 shown in FIG. 1, for example. The vibrating stripping device 560 includes a stripping member 562, and a drive mechanism for vibrating the stripping member 562 at a desired frequency. In the illustrated embodiment, the drive mechanism includes one or more piezoelectric elements 564 and one or more piezoelectric elements 565. (A single piezoelectric element 564 and a single piezoelectric element 565 are shown in FIG. 5). The stripping member 562 and piezoelectric elements 564, 565 form an acoustic transducer. The piezoelectric elements 564, 565 are located between the stripping member 562 and a support member 566. In embodiments, the piezoelectric elements 564 are arranged in a first series and the piezoelectric elements 565 are arranged in a second series along the length dimension of the vibrating stripping device 560. The first and second series of the piezoelectric elements 564, 565 can extend parallel to each other with the piezoelectric elements 564, 565 arranged in pairs.

The support member 566 can be rigidly attached to a portion of the printing apparatus 100, such as a sub-frame, in which the vibrating stripping device 560 is provided.

The stripping member 562 can have the same configuration as the stripping member 262, for example.

The piezoelectric elements 564, 565 can have the same configuration and composition. The piezoelectric elements 564, 565 can be comprised of the same materials as the piezoelectric elements 264, for example.

In the vibrating stripping device 560, the drive mechanism supplies electrical current to the piezoelectric elements 564, 565. As shown in FIG. 5, when electrical current is applied to the piezoelectric elements 564 and the piezoelectric elements 565, the piezoelectric elements 564 can expand in direction D toward a fixing belt 502, while the piezoelectric elements 565 can simultaneously contract in the reverse direction E away from the fixing belt 502. The directions D and E can be perpendicular to an inner surface 504 of the fixing belt 502. Then, the piezoelectric elements 564 can contract in a direction opposite to direction D away from the fixing belt 502, while the piezoelectric elements 565 can simultaneously expand in a direction opposite to direction E toward the fixing belt 502. This synchronized expansion and contraction of the piezoelectric elements 564, 565 causes the stripping member 562 to move in the reverse directions C toward and away from the fixing belt 502. The directions C can be perpendicular to the inner surface 504 of the fixing belt 502. This motion induces vibratory motion to a stripping surface 576 of the stripping member 562 at which the fixing belt 502 contacts the stripping member 562 and adjacent to which media are separated from the outer surface 568 of the fixing belt 502.

In the vibrating stripping device 560, electrical current is supplied to the piezoelectric elements 564 by a driver 580 of the drive mechanism, and an electrical current is supplied to the piezoelectric elements 565 by a driver 582 of the drive mechanism, to cause the piezoelectric elements 564, 565 to change shape and/or volume to impart high-frequency vibration to the fixing belt 502. When the fixing belt 502 is coupled to the stripping member 562, the fixing belt 502 can follow the motion of the stripping surface 576 caused by high-frequency shape and/or volume changes of the piezoelectric elements 564, 565 and undergo sufficiently-high levels of acceleration substantially normal to the process direction of the fixing belt 502. The high-frequency vibratory motion focused at the stripping surface 576 counteracts the adhesion force of media/marking material to the outer surface 568 of the fixing belt 502, allowing robust stripping of various types of media to occur at the stripping surface 576. The acceleration of the stripping surface 576 can be controlled to tune the stripping force for different media weights.

The drivers 580, 582 can each comprise, e.g., an electrical power driver circuit as disclosed in Richmond et al. The vibrating stripping device 560 including the stripping member 562, piezoelectric elements 564, 565 and the support member 566 (when rigidly attached to the piezoelectric elements 564, 565) can be driven at a relatively high frequency by the drivers 580, 582. For example, the drivers 580, 582 can operate at a frequency, f, of about 5 KHz to about 200 KHz, such as about 5 kHz to about 50 KHz, about 50 KHz to about 100 KHz, or about 100 KHz to about 200 KHz.

The vibrating stripping device 560, or the system also including the fixing belt 502, can be driven by the drivers 580, 582 to vibrate at its resonant frequency under different temperature and load conditions. Embodiments of drivers 580, 582 can include a phase lock loop power supply, as described in Richmond et al., to track, and adjust to, variations in the resonant frequency of the vibrating stripping device 560 or system.

Figure 6:
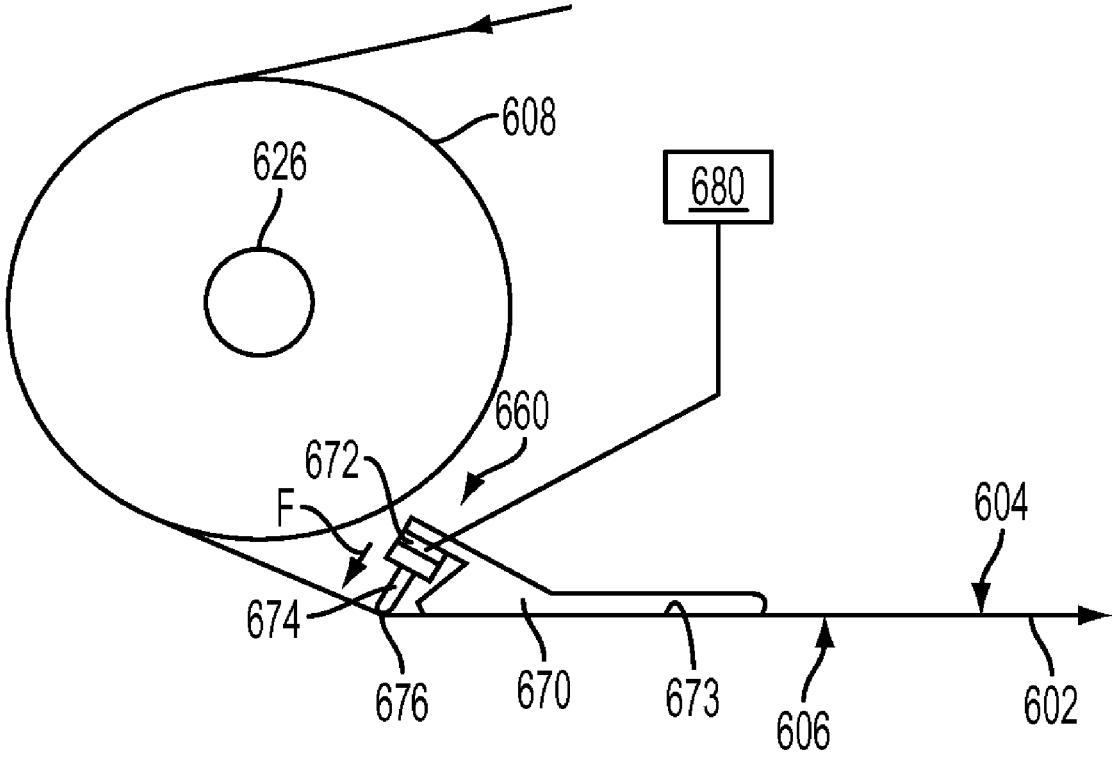
FIG. 6 illustrates another exemplary embodiment of a fixing device including a fixing belt and a vibrating stripping device.

FIG. 6 depicts a portion of a fixing device including a vibrating stripping device 660 according to another exemplary embodiment. As shown, a fixing belt 602 extends over a fixing roll 608 including a heating element 626. The fixing device can have the same configuration as, e.g., the fixing device 200 shown in FIG. 2. The vibrating stripping device 660 includes a support member 670 including a surface 673 contacting an inner surface 604 of the fixing belt 602. The support member 670 can have any suitable configuration. One or more piezoelectric elements 672 (a single piezoelectric element 672 is shown in FIG. 6) of a drive mechanism are disposed between the support member 670 and a stripping member configured as a waveguide 674. The piezoelectric elements 672 are included in a drive mechanism for vibrating the waveguide 674. The piezoelectric elements 672 and the waveguide 674 form a horn-shaped transducer. The waveguide 674 is configured to amplify motion of the piezoelectric elements 672. The waveguide 674 can comprise a series of waveguide segments arranged along the length dimension of the vibrating stripping device 660. Exemplary horn-shaped transducers that can be used for the waveguide 674 are disclosed in Richmond et al. and in U.S. Pat. No. 5,010,369 to Nowak et al., which is incorporated herein by reference in its entirety. The piezoelectric elements 672 can also be arranged in series along the length dimension of the vibrating stripping device 660.

The support member 670 can be rigidly attached to a portion of the printing apparatus 100, such as a sub-frame, in which the vibrating stripping device 660 is provided.

The piezoelectric elements 672 can comprise the same materials as the piezoelectric elements 264, for example.

The drive mechanism of the vibrating stripping device 660 supplies electrical current to the piezoelectric elements 672. When an electrical current is applied to the piezoelectric elements 672, they expand in direction F toward the fixing belt 602, and then contract in the reverse direction away from the fixing belt 602. These directions can be perpendicular to the inner surface 604 of the fixing belt 602. This vibratory motion induces vibration to the tip of the waveguide 674 including a stripping surface 676 at which the fixing belt 602 contacts the waveguide 674 and adjacent to which media are separated from an outer surface 606 of the fixing belt 602. The stripping surface 676 is curved and can have a curvature defined by a radius of about 0.5 mm to about 5 mm, for example.

In the vibrating stripping device 660, electrical current is supplied to the piezoelectric elements 672 by a driver 680, to cause the piezoelectric elements 672 to change shape and/or volume to provide high-frequency vibration to the fixing belt 602. When the fixing belt 602 is coupled to the waveguide 674, the fixing belt 602 follows the motion of the stripping surface 676 caused by high-frequency shape and/or volume changes of the piezoelectric elements 672 and undergo sufficiently-high levels of acceleration substantially normal to the process direction of the fixing belt 602. The high-frequency vibratory motion focused at the stripping surface 676 counteracts the adhesion force of media/marking material to the outer surface 606 of the fixing belt 602, allowing robust stripping of various types of media to occur at the stripping surface 676. The acceleration of the stripping surface 676 can be controlled to tune the stripping force for different media weights.

The driver 680 can comprise, e.g., an electrical power driver circuit as disclosed in Richmond et al. The vibrating stripping device 660 including the waveguide 674, piezoelectric elements 672 and the support member 670 (when rigidly attached to the piezoelectric elements 672) can be driven at a relatively high frequency by the driver 680. For example, the driver 680 can operate at a frequency, f, of about 5 KHz to about 200 KHz, such as about 5 KHz to about 50 KHz, about 50 KHz to about 100 KHz, or about 100 KHz to about 200 KHz.

The vibrating stripping device 660, or the system also including the fixing belt 602, can be driven by the driver 680 to vibrate at its resonant frequency under different temperature and load conditions. Embodiments of driver 680 can include a phase lock loop power supply, as described in Richmond et al., to track, and adjust to, variations in the resonant frequency of the vibrating stripping device 660 or system.

Embodiments of the fixing devices including a vibrating stripping device 260, 560 or 660 can provide the following advantages: the ability to distribute stripping energy uniformly across media; reduced thermal non-uniformity, reduced convective energy losses, reduced heat transfer to nearby transports, and reduced differential cooling across images, as compared with the use of air knives for stripping media; and reduced friction at the stripping device/fixing belt interface, which can reduce belt wear and drive torque requirements in fixing devices.

Embodiments of the fixing devices including a vibrating stripping device 260, 560 or 660 can also provide improved fixing of marking material to media as a result of the energy supplied to the media/marking material by their vibrating motion.

Embodiments of the vibrating stripping devices can include drive mechanisms that do not include piezoelectric elements and associated drivers, but which can also provide the desired vibration to a stripping member that contacts a fixing belt, e.g., a vibration frequency of about 5 KHz to about 200 KHz. For example, in other embodiments of the vibrating stripping devices, vibration of the stripping member can be produced by drive mechanisms that include one or more motors, electromagnets, micro-actuators, combinations of these devices, or any other suitable devices, including the associated drive circuitry, which can produce vibration of the stripping member at the desired frequency in response to the application of energy or a signal.

It will be understood that the teachings and claims herein can be applied to any treatment of marking material on different types of media. For example, the marking material can be comprised of toner, liquid or gel ink, and/or heat- or radiation-curable ink; and/or the medium can utilize certain process conditions, such as temperature and pressure, for successful printing. The process conditions that may be desirable for the treatment of different types of marking materials on different media types can vary in embodiments of the fixing devices.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing onto media, comprising:

a first member including a first surface;

a second member;

a fixing belt supported on the second member, the fixing belt being actively heated and including an inner surface and an outer surface, the first surface and the outer surface forming a nip at which media are received; and a vibrating stripping device disposed between the second member and the inner surface of the fixing belt, the vibrating stripping device comprising a stripping member including a stripping surface and a drive mechanism, the drive mechanism produces vibration of the stripping surface and the fixing belt, the vibration of the fixing belt assists separation of media passed through the nip from the outer surface of the fixing belt adjacent to the stripping surface of the stripping member.

2. The apparatus of claim 1, wherein the drive mechanism comprises at least one piezoelectric element contacting the stripping member, and at least one driver connected to the at least one piezoelectric element for supplying electrical current to the at least one piezoelectric element, when the at least one driver supplies electrical current to the at least one piezoelectric element, the at least one piezoelectric element produces the vibration of the stripping surface and the fixing belt.

3. The apparatus of claim 2, wherein the at least one driver is operable to cause the stripping surface to vibrate at a frequency of about 5 KHz to about 200 KHz.

4. The apparatus of claim 2, wherein:

the vibrating stripping device comprises a support member fixedly attached to a portion of the apparatus;

a plurality of the piezoelectric elements are disposed between, and attached to, the support member and the stripping member; and the at least one driver comprises an electrical power driver circuit which causes the vibrating stripping device to vibrate at a resonant frequency thereof.

5. The apparatus of claim 2, wherein the vibrating stripping device comprises:

a plurality of first piezoelectric elements arranged in a first series along a length dimension of the vibrating stripping device;

a plurality of second piezoelectric elements arranged in a second series along the length dimension of the vibrating stripping device;

a first driver connected to the first piezoelectric elements for supplying electrical current to the first piezoelectric elements; and a second driver connected to the second piezoelectric elements for supplying electrical current to the second piezoelectric elements;

wherein the first driver and the second driver are operable (i) to cause the first piezoelectric elements to expand in a first direction while the second piezoelectric elements simultaneously contract in a second direction opposite to the first direction and (ii) to cause the first piezoelectric elements to contract in the first direction while the second piezoelectric elements simultaneously expand in the second direction, to produce the vibration of the stripping surface and the fixing belt.

6. The apparatus of claim 5, wherein:

the vibrating stripping device comprises a support member fixedly attached to a portion of the apparatus;

the first piezoelectric elements and the second piezoelectric elements are disposed between, and attached to, the support member and the stripping member; and the first driver comprises a first electrical power driver circuit and the second driver comprises a second electrical power driver circuit which cause the vibrating stripping device to vibrate at a resonant frequency thereof.

7. The apparatus of claim 1, wherein the stripping surface has a curvature defined by a radius of about 0.5 mm to about 5 mm.

8. The apparatus of claim 1, wherein the stripping member comprises a stripping shoe.

9. The apparatus of claim 1, wherein the stripping member comprises a waveguide including a tip having the stripping surface.

10. An apparatus useful in printing onto media, comprising:

a first roll including a first surface;

a second roll including a second surface;

a heated fixing belt including an inner surface and an outer surface;

a first nip formed by contact between the inner surface of the fixing belt and the second surface and contact between the outer surface of the fixing belt and the first surface, the first nip including a first inlet end and a first outlet end at which the fixing belt separates from the second surface;

a second nip formed by contact between the outer surface of the fixing belt and the first surface, the second nip extending from the first outlet end to a second outlet end at which the fixing belt separates from the first surface; and a vibrating stripping device disposed between the second surface and the inner surface of the fixing belt, the vibrating stripping device comprising a stripping member including a stripping surface and a drive mechanism, the drive mechanism produces vibration of the stripping surface and the fixing belt, the vibration of the fixing belt assists separation of media passed through the first nip and the second nip from the outer surface of the fixing belt adjacent to the stripping surface of the stripping member.

11. The apparatus of claim 10, wherein:

the drive mechanism comprises at least one piezoelectric element contacting the stripping member, and at least one driver connected to the at least one piezoelectric element for supplying electrical current to the at least one piezoelectric element; and when the at least one driver supplies electrical current to the at least one piezoelectric element, the at least one piezoelectric element produces the vibration of the stripping surface and the fixing belt.

12. The apparatus of claim 11, wherein the at least one driver is operable to cause the stripping surface to vibrate at a frequency of about 5 KHz to about 200 KHz.

13. The apparatus of claim 11, wherein:

the vibrating stripping device comprises a support member fixedly attached to a portion of the apparatus;

a plurality of the piezoelectric elements are disposed between, and attached to, the support member and the stripping member; and the at least one driver comprises an electrical power driver circuit which causes the vibrating stripping device to vibrate at a resonant frequency of the vibrating stripping device.

14. The apparatus of claim 11, wherein the vibrating stripping device comprises:

a plurality of first piezoelectric elements arranged in a first series along a length dimension of the vibrating stripping device;

a plurality of second piezoelectric elements arranged in a second series along the length dimension of the vibrating stripping device;

a first driver connected to the first piezoelectric elements for supplying electrical current to the first piezoelectric elements; and a second driver connected to the second piezoelectric elements for supplying electrical current to the second piezoelectric elements;

wherein the first driver and the second driver are operable (i) to cause the first piezoelectric elements to expand in a first direction toward the fixing belt while the second piezoelectric elements simultaneously contract in a second direction opposite to the first direction and (ii) to cause the first piezoelectric elements to contract in the first direction while the second piezoelectric elements simultaneously expand in the second direction, to produce the vibration of the stripping surface and the fixing belt.

15. The apparatus of claim 14, wherein:

the vibrating stripping device comprises a support member fixedly attached to a portion of the apparatus;

the first piezoelectric elements and the second piezoelectric elements are disposed between, and attached to, the support member and the stripping member; and the first driver comprises a first electrical power driver circuit and the second driver comprises a second electrical power driver circuit which cause the vibrating stripping device to vibrate at a resonant frequency thereof.

16. The apparatus of claim 10, wherein the stripping member comprises a stripping shoe and the stripping surface has a curvature defined by a radius of about 0.5 mm to about 5 mm.

17. The apparatus of claim 10, wherein the stripping member comprises a waveguide including a tip having the stripping surface and the stripping surface has a curvature defined by a radius of about 0.5 mm to about 5 mm.

18. A method of stripping media from a surface in an apparatus useful in printing onto media, the apparatus comprising a first member including a first surface, a second member including a second surface, a fixing belt supported on the second surface, the fixing belt being actively heated and including an inner surface and an outer surface, the first surface and the outer surface forming a nip at which media are received, and a vibrating stripping device disposed between the second surface and the inner surface of the fixing belt, the vibrating stripping device comprising a stripping member including a stripping surface and a drive mechanism, the method comprising:

actively heating the fixing belt;

activating the drive mechanism to produce vibration of the stripping surface and the fixing belt;

feeding a medium carrying a marking material to the nip, the marking material contacting the outer surface of the fixing belt; and stripping the medium from the outer surface of the fixing belt after the medium passes through the nip, wherein the vibration of the fixing belt assists separation of the medium from the outer surface of the fixing belt adjacent to the stripping surface of the stripping member.

19. The method of claim 18, wherein:

the nip comprises:

a first nip formed by contact between the inner surface of the fixing belt and the second surface and contact between the outer surface of the fixing belt and the first surface, the first nip including a first inlet end and a first outlet end at which the fixing belt separates from the second surface; and a second nip formed by contact between the outer surface of the fixing belt and the first surface, the second nip extending from the first outlet end to a second outlet end at which the fixing belt separates from the first surface; and the vibrating stripping device is disposed between the second surface and the inner surface of the fixing belt downstream from the second nip.

20. The method of claim 18, wherein the drive mechanism causes the stripping surface to vibrate at a frequency of about 5 KHz to about 200 KHz.

21. The method of claim 18, wherein:

the drive mechanism comprises at least one piezoelectric element contacting the stripping member, and at least one driver connected to the at least one piezoelectric element; and the at least one driver supplies electrical current to the at least one piezoelectric element to cause the vibrating stripping device to vibrate at a resonant frequency thereof.

* * * * *